US006321861B1

(12) United States Patent
Leichter

(10) Patent No.: US 6,321,861 B1
(45) Date of Patent: Nov. 27, 2001

(54) AUGER

(76) Inventor: Henry S. Leichter, 5100 S. Convent La., Suite 406, Philadelphia, PA (US) 19114

( * ) Notice: Subject to any disclaimer, the term of this patent is extended or adjusted under 35 U.S.C. 154(b) by 0 days.

(21) Appl. No.: 09/591,718

(22) Filed: Jun. 12, 2000

Related U.S. Application Data

(60) Provisional application No. 60/139,288, filed on Jun. 15, 1999.

(51) Int. Cl.[7] ..... A45F 3/44; E21B 10/44; E21B 17/22; F16B 39/30

(52) U.S. Cl. ..... 175/323; 135/99; 258/156; 411/310

(58) Field of Search ..... 135/15.1, 98, 99, 135/118; 175/19, 320, 323, 394; 248/156, 508, 545; 411/308, 309, 310, 311

(56) References Cited

U.S. PATENT DOCUMENTS

| | | | | |
|---|---|---|---|---|
| 200,217 | * | 2/1878 | Mudgett | 256/58 |
| 495,471 | | 4/1893 | Brown | 52/153 |
| 906,438 | | 12/1908 | Lemerand | 119/789 |
| 2,103,948 | * | 12/1937 | Jones | 248/530 |
| 2,190,222 | * | 2/1940 | Strasser | 248/158 |
| 2,211,283 | * | 8/1940 | Mercer | 135/15.1 |
| 2,441,109 | * | 5/1948 | Carlson | 403/86 |
| 2,628,797 | * | 2/1953 | Campomar | 248/545 |
| 3,710,523 | | 1/1973 | Taylor | 52/157 |
| 4,778,142 | * | 10/1988 | Roba | 248/545 |
| 4,832,304 | * | 5/1989 | Morgulis | 248/533 |
| 4,850,564 | * | 7/1989 | Padin | 248/533 |
| 4,920,897 | | 5/1990 | Reed et al. | 108/150 |
| 4,967,855 | * | 11/1990 | Moser | 175/398 |
| 5,046,699 | | 9/1991 | Perreault et al. | 248/533 |
| 5,088,681 | | 2/1992 | Procaccianti et al. | 248/530 |
| 5,098,057 | | 3/1992 | Gran et al. | 248/530 |
| 5,122,014 | | 6/1992 | Genfan | 405/244 |
| 5,152,495 | | 10/1992 | Jacinto et al. | 248/545 |
| 5,199,361 | | 4/1993 | Robinson | 109/51 |
| 5,358,209 | | 10/1994 | Ward | 248/545 |
| 5,417,166 | * | 5/1995 | Credle, Sr. | 108/50.12 |
| 5,482,246 | | 1/1996 | Derkoski | 248/530 |
| 5,636,944 | | 6/1997 | Buttimore | 405/244 |

* cited by examiner

*Primary Examiner*—David Bagnell
*Assistant Examiner*—Jennifer H Gay
(74) *Attorney, Agent, or Firm*—Ratner & Prestia

(57) ABSTRACT

An auger is produced from a material such as plastic. The auger includes a shaft with a first pointed end having a thread member thereon. A second end of the auger includes an opening. Handles extend perpendicularly from the shaft and near the opening. The threads are formed in a manner to facilitate removal of the auger from a mold in which the auger may be formed using a plastic-type material. On opposite ends of the shaft, the thickness of the thread is increased to provide a clearance for the thread so that the completed auger may be readily removed from the mold.

18 Claims, 4 Drawing Sheets

AUGER

This application claims benefit of provisional application 60/139,288, filed Jun. 15, 1999.

FIELD OF THE INVENTION

The present invention relates, in general, to augers and in particular, to augers which are used for securing objects in a material such as sand. Specifically, an auger is described which may be readily manufactured in a material such as plastic.

BACKGROUND OF THE INVENTION

When going to a location such as a beach, it is often customary to bring along an umbrella for shade. In the prior art, such an umbrella included a pointed shaft. The pointed shaft was inserted into the sand. The user of the umbrella would attempt to push the umbrella as deeply as possible into the sand to prevent the umbrella from being knocked out of the sand by a strong gust of wind.

Unfortunately, such attempts to maintain the umbrella in place have not been successful. Specifically, it is known to experience a strong gust of wind which knocks the umbrella out of place. As a result, the umbrella may be flung along the beach, causing a potential safety hazard.

In an attempt to rectify this problem, various augers have been developed. An exemplary auger is illustrated, for example, in U.S. Pat. No. 5,046,699 (Perreault et al.). As disclosed, the auger includes a first end with a screw thread at a first end of a shaft. A second end of the shaft includes an opening. A plurality of handles extend perpendicularly from the shaft and near the opening. In operation, the thread member is held against the sand and the handles are rotated, thus causing the auger to be screwed into the sand. After the auger has been screwed into the sand, a beach umbrella may be inserted into the opening. In this manner, the end of the beach umbrella is able to extend a considerable distance below the top surface of the sand.

SUMMARY OF THE INVENTION

An auger is produced from a material such as plastic. The auger includes a shaft with a first pointed end having a thread member thereon. A second end of the auger includes an opening. Handles extend perpendicularly from the shaft and near the opening. The threads are formed in a manner to facilitate removal of the auger from a mold in which the auger may be formed using a plastic-type material. On opposite ends of the shaft, the thickness of the thread is increased to provide a clearance for the thread so that the completed auger may be readily removed from the mold.

DETAILED DESCRIPTION OF THE INVENTION

Figure 1:
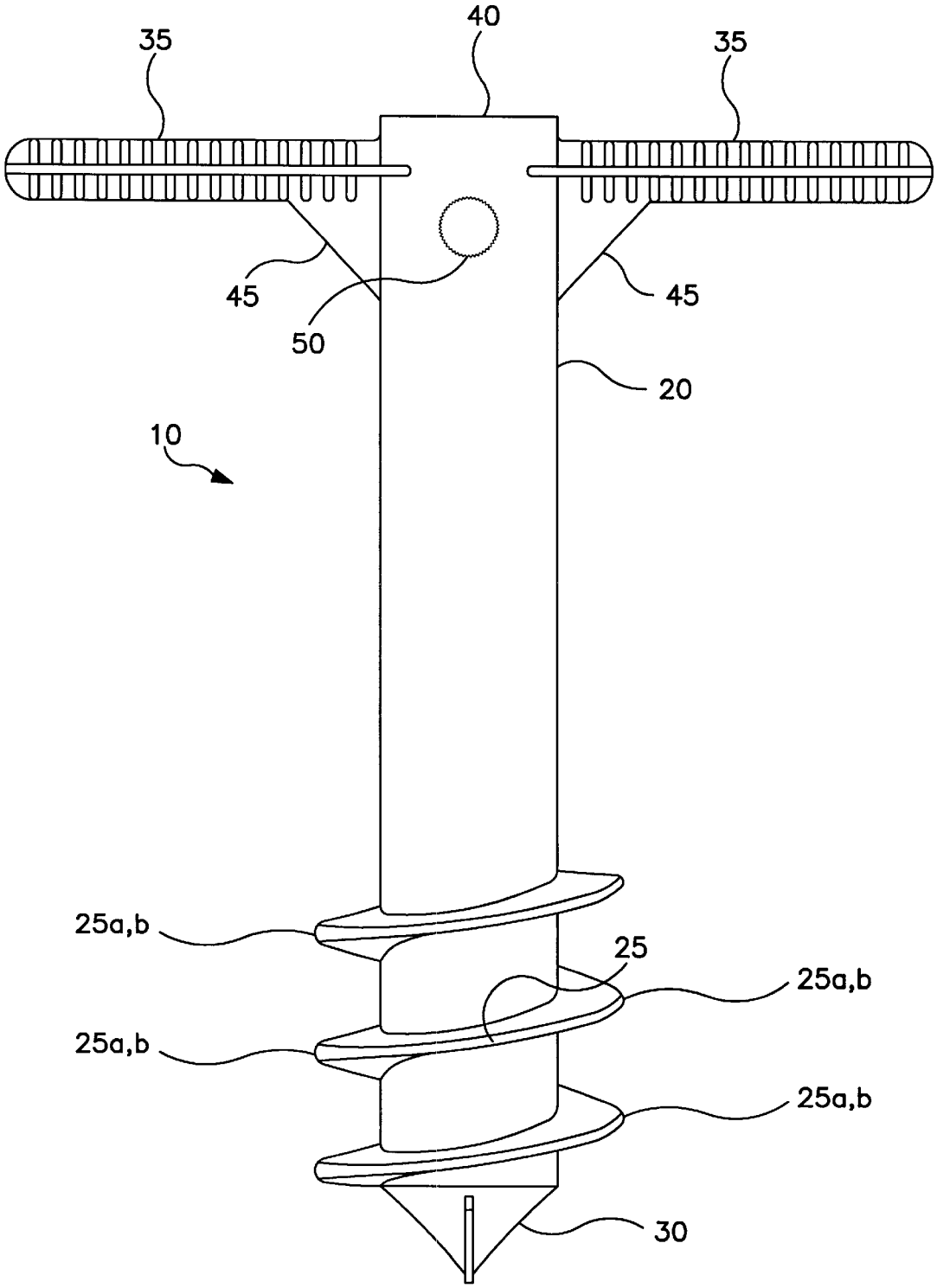
FIG. 1 is a side view of an auger in accordance with an exemplary embodiment of the present invention.

Auger 10 is shown in FIG. 1. Auger 10 includes shaft 20 which may terminate at a first end 30 which may, for example, be pointed. Furthermore, on the second end of shaft 20 relative to bottom portion 30, opening 40 is provided. Thus, shaft 20 may be hollow. The pole of an umbrella may be inserted through opening 40 and lowered into shaft 20. Thread 25 is situated near bottom portion 30. As shown, thread 25 extends from a location adjacent to bottom portion 30 (i.e. from the first end of shaft 20) and along shaft 20 towards opening 40.

Handles 35 are also provided. Handles 35 extend perpendicularly in opposite directions, for example, from shaft 20. As shown, handles 35 extend from shaft 20 adjacent to opening 40.

To strengthen the manner in which handles 35 are coupled to shaft 20, support members 45 are optionally provided. Support members 45 may be angled, as shown, to provide additional support in order to ensure that handles 35 do not break off of shaft 20 during the operation of rotating auger 10 into a material such as sand.

Screw member 50 is provided. Once an umbrella shaft is inserted through opening 40 and lowered within shaft 20, screw member 50 may be rotated in order to help maintain the umbrella shaft in place within shaft 20.

Figure 2:
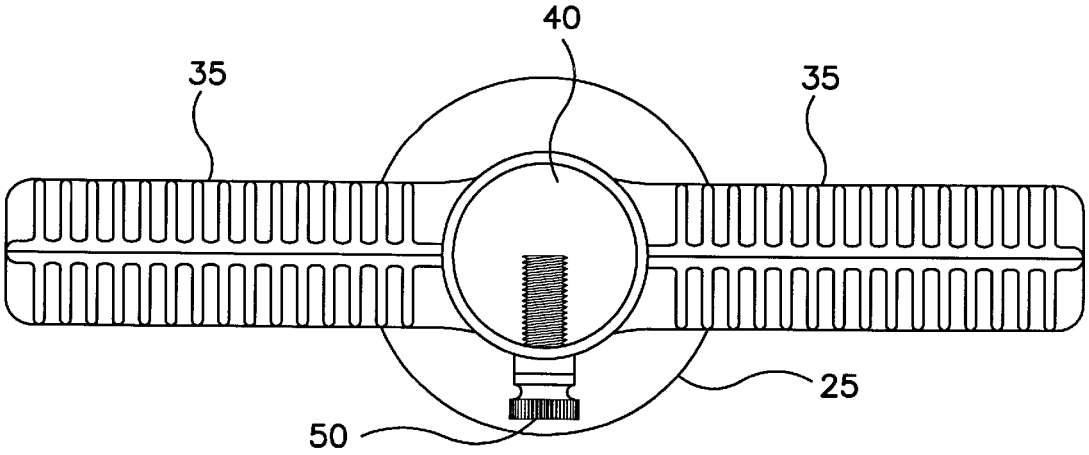
FIG. 2 is a top view of an auger in accordance with an exemplary embodiment of the present invention.

FIG. 2 is a top view of auger 10 in accordance with an exemplary embodiment of the present invention. FIG. 2 helps to illustrate how handles 35 may extend from shaft 20 in opposite directions. Also shown in FIG. 2 is screw member 50 extending within shaft 20. Again, screw member 50 may be rotated in order to help maintain an umbrella shaft in place within shaft 20. In FIG. 2, screw member 50 is visible within shaft 20 by virtue of opening 40 which allows an umbrella pole to be inserted into shaft 20.

Figure 3:
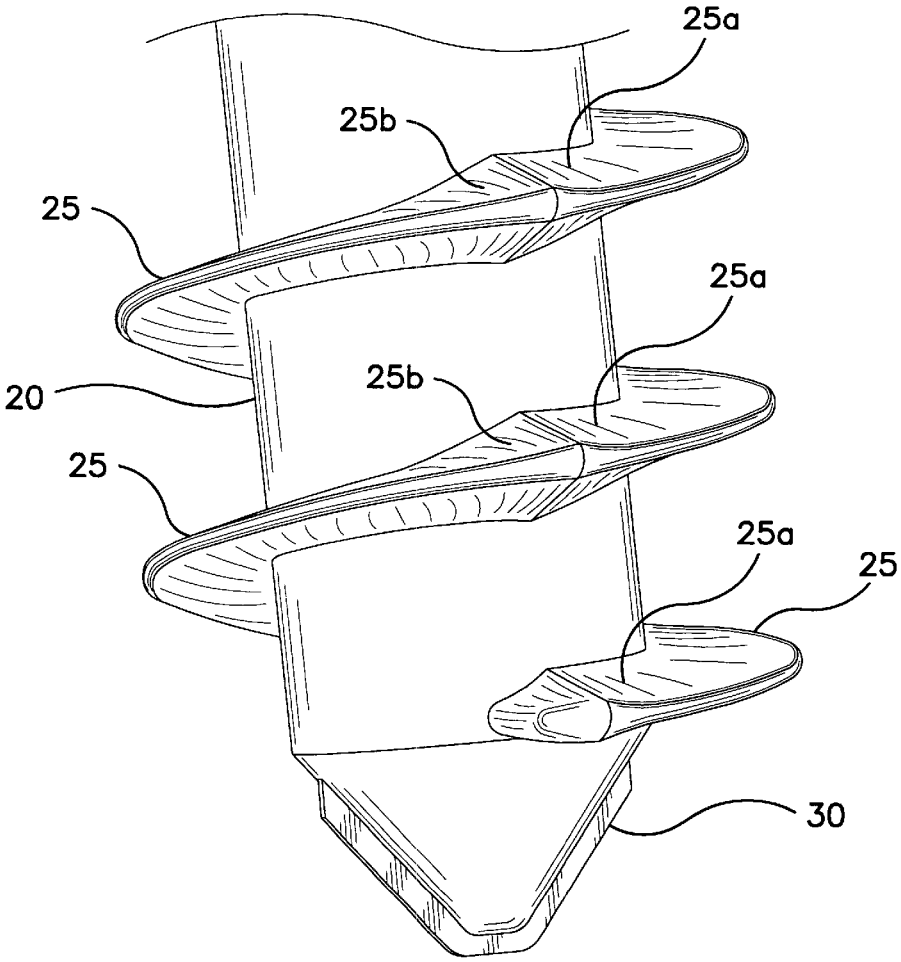
FIG. 3 is a perspective view which helps to illustrate the thickened portions of the thread shown in FIG. 1 in accordance with an exemplary embodiment of the present invention.

FIG. 3 is a perspective view which helps to illustrate thread 25 previously shown in FIG. 1. As shown in FIG. 3, the thickness of thread 25 is not uniform as it goes along the exterior of shaft 20. As shown, thread 25 includes thickened thread portions 25*a,b*. The thickened thread portions 25*a,b* provide a clearance during the manufacturing process 10 as more clearly set forth below. The thickened thread portions 25*a, b* are situated, for example, along opposite sides of shaft 20. Thus, one set of thread portions 25*a, b* may be separated from another set of thread portions 25*a, b* by 180°.

When forming a material, such as an auger, in plastic, a mold is typically used. The mold is filled with plastic in a liquefied form. Upon the liquid solidifying, the mold is opened and the finished plastic component is removed from the mold.

In an exemplary embodiment of the present invention, auger 10 is formed so as to facilitate removal thereof from a mold. In order to facilitate is such removal, thickened thread portions 25*a,b* as shown in FIG. 3 are provided. For example, thickened thread portions 25*a,b* may be formed on shaft 20 and directly below both of handles 35.

Thickened thread portions 25*a,b* are provided so that there is a clearance for the portions of the thread below thickened thread portions 25*a,b* within the mold. Thus, for example, there are spaces formed in the mold corresponding to thickened thread portions 25*a,b*. These spaces provide a clearance. Thus, as the completed auger is lifted out of the mold, the clearance allows the thread portions below thickened thread portions 25*a,b* to readily be lifted out of the mold. In this manner, removal of auger 10 from a mold is facilitated.

The invention has been described for use with umbrellas and sand. This use is merely provided as an example. The auger may be used with any device for which it is desirable for that device to be secured to the ground.

Figure 4:
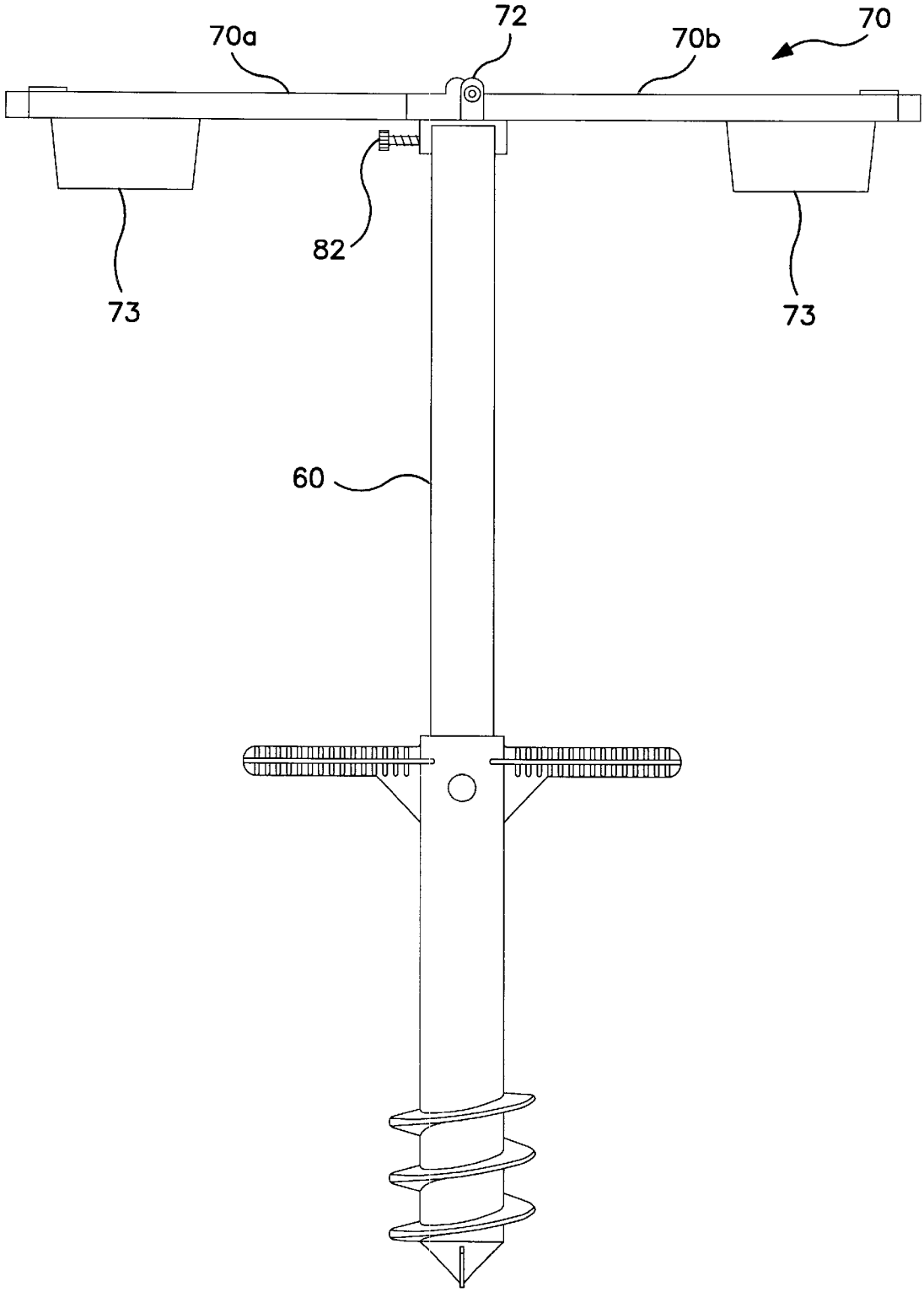
FIG. 4 is a side view of an auger used with a table apparatus in accordance with a further exemplary embodiment of the present invention.

FIG. 4 is a table apparatus which may be used with the auger in accordance with an exemplary embodiment of the present invention. Shaft 60 is shown. Table apparatus 70 includes an opening into which shaft 60 is inserted. A screw mechanism 82 may be included with table apparatus 70 in order to secure table apparatus 70 to shaft 60. Table apparatus 70 may be comprised of table portion 70*a* and table portion 70*b*. Table portion 70*a* is affixed to table portion 70*b* by hinge mechanism 72. Cup holder 73, for example, may be included in a further exemplary embodiment of the present invention.

Figure 5:
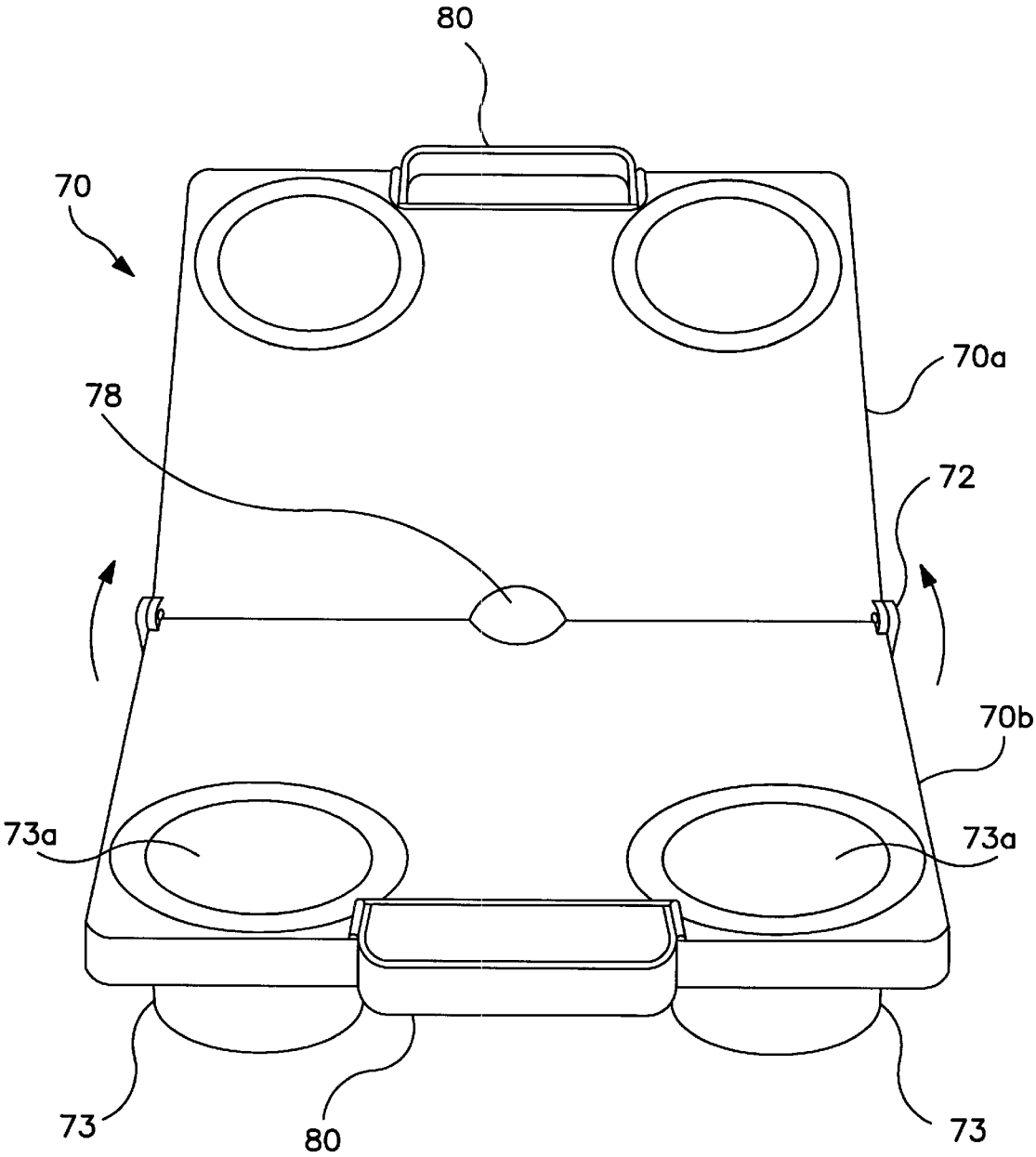
FIG. 5 is a prospective view of the table apparatus shown in FIG. 4.

FIG. 5 is a prospective view of table apparatus 70. As shown in FIG. 5, table portion 70*a* swivels relative to table portion 70*b* via hinge mechanism 72. Opening 78 is also included. As previously stated, shaft 60 slides through opening 78. Table apparatus 70 may include, for example, a screw which penetrates a sidewall which defines opening 70 and which engages shaft 60 orthogonal thereto. Handles 80 also is included.

As shown in FIG. 5, cup holders 73 may be included. It is understood, however, that the inclusion of cup holders 73 is completely optional. Cup holders 73 are defined by a plurality of opening 73*a* and a plurality of cup shaped members which project from the bottom table apparatus 70. Thus, the cup holders facilitate the holding of cups.

It is also understood that the inclusion of handles 80 is completely optional.

In actual use, table apparatus 70 may be folded in half prior to use. For actual use, table apparatus 70 is opened in a direction of the arrow shown in FIG. 5 to provide a full table surface. After the auger is screwed in, for example, the sand, shaft 60 is inserted into the auger, table apparatus 70 is situated about shaft 60 via through hole 78 and screw member 82, for example, is rotated to secure table apparatus 70 relative to shaft 60.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

What is claimed:

1. An auger, comprising:

a shaft having a first end and a second end;

a screw thread extending from substantially said first end toward said second end along an axis;

said second end including an opening to permit penetration into the interior of said shaft;

at least one handle extending from said shaft;

wherein said thread is of unequal thickness around and along said axis.

2. An auger according to claim 1, wherein portions of said thread of unequal thickness are thicker than remaining portions of said thread, said portions of said thread of unequal thickness are situated on opposite sides about said shaft.

3. An auger according to claim 1, wherein said thread includes thickened portions on opposite sides about said shaft.

4. An auger according to claim 1, said auger further comprising a screw inserted in a further opening formed in said auger, wherein tightening of said screw applies pressure to a member situated in said shaft in order to maintain said member in said shaft.

5. An auger according to claim 1, wherein said thread includes thickened portions at each opposite side about said shaft.

6. Au auger according to claim 1, wherein a plurality of handles extend from said shaft.

7. An auger according to claim 6, further comprising support members extending between said shaft and said handles, said support members providing increased strength for maintaining said handles to said shaft.

8. An auger, comprising:

a shaft having a first end and a second end;

a screw thread extending from substantially said first end toward said second end along an axis;

said second end including an opening to permit penetration into the interior of said shaft;

wherein said thread is of repeating increased followed by decreased thickness.

9. An auger according to claim 8, wherein two portions of said thread of increased thickness are situated on opposite sides about said shaft with a portion of said thread of decreased thickness thinner than said portions of increased thickness situated therebetween.

10. An auger according to claim 8, wherein said thread is of increased thickness in a plurality locations about each opposite side about said shaft.

11. An auger according to claim 8, said auger further comprising a screw inserted in a further opening formed in said auger, wherein tightening of said screw applies pressure to a member situated in said shaft in order to maintain said member in said shaft.

12. An auger according to claim 8, further comprising a plurality of handles extending from said shaft substantially near said second end.

13. An auger according to claim 12, further comprising support members extending between said shaft and said handles, said support members providing increased strength for maintaining said handles to said shaft.

14. An auger according to claim 8, wherein said thread includes thickened portions at each opposite side about said shaft.

15. An auger, comprising.

a shaft having a first end and a second end;

a screw thread extending from substantially said first end toward said second end along an axis;

said second end including an opening to permit penetration into the interior of said shaft;

wherein said thread is of unequal thickness around and along said axis.

16. An auger according to claim 15, wherein portions of said thread of unequal thickness are thicker than remaining portions of said thread, said portions of said thread of unequal thickness are situated on opposite sides about said shaft.

17. An auger according to claim 15, wherein said thread includes thickened portions on opposite sides about said shaft.

18. An auger according to claim 15, said auger further comprising a screw inserted in a further opening formed in said auger, wherein tightening of said screw applies pressure to a member situated in said shaft in order to maintain said member in said shaft.

* * * * *